US008875412B1

(12) United States Patent
Anderson

(10) Patent No.: US 8,875,412 B1
(45) Date of Patent: Nov. 4, 2014

(54) GRAIN DRYING APPARATUS

(76) Inventor: Allan Anderson, Leeland, IA (US)

( * ) Notice: Subject to any disclaimer, the term of this patent is extended or adjusted under 35 U.S.C. 154(b) by 277 days.

(21) Appl. No.: 13/438,830

(22) Filed: Apr. 3, 2012

(51) Int. Cl.
*F26B 11/02* (2006.01)

(52) U.S. Cl.
USPC ..... 34/90; 34/166; 34/174; 431/197; 431/198; 431/354; 165/177; 392/395

(58) Field of Classification Search
USPC ..... 34/90, 166, 173, 174; 431/195, 196, 431/197, 354; 165/177; 392/395
See application file for complete search history.

(56) References Cited

U.S. PATENT DOCUMENTS

| | | | | |
|---|---|---|---|---|
| 3,704,780 | A | | 12/1972 | Aidlin et al. |
| 4,004,351 | A | | 1/1977 | Sanneman et al. |
| 4,183,430 | A | | 1/1980 | Hunter |
| 4,404,756 | A | | 9/1983 | Noyes |
| 4,471,868 | A | | 9/1984 | Buschbom et al. |
| 4,630,382 | A | | 12/1986 | Keiler et al. |
| 4,732,260 | A | | 3/1988 | Canziani |
| 5,039,827 | A | | 8/1991 | Harmon |
| 5,048,671 | A | | 9/1991 | Ellsworth |
| 5,197,871 | A | * | 3/1993 | Yamamoto et al. ..... 431/262 |
| 5,449,263 | A | | 9/1995 | Campbell et al. |
| 5,593,019 | A | | 1/1997 | Schlagel |
| 5,860,221 | A | | 1/1999 | Morrison et al. |
| 5,975,887 | A | * | 11/1999 | Kamal et al. ..... 431/181 |
| 6,073,364 | A | | 6/2000 | McKenzie et al. |
| 6,073,367 | A | | 6/2000 | McKenzie et al. |
| 6,076,276 | A | | 6/2000 | McKenzie et al. |
| 6,233,843 | B1 | | 5/2001 | McKenzie et al. |
| 6,834,442 | B1 | | 12/2004 | Bloemendal |
| 7,036,657 | B1 | | 5/2006 | Robinson |
| 7,874,835 | B2 | * | 1/2011 | Schwank et al. ..... 431/354 |
| 2008/0304945 | A1 | | 12/2008 | Hlinka |

* cited by examiner

*Primary Examiner* — Steve M Gravini

(57) ABSTRACT

A dryer burner apparatus includes a gas supply line that is fluidly coupled to a gas supply. A burner tube is fluidly coupled the gas supply line and has a top side and a bottom side. The burner tube has a plurality of apertures extending therethrough and the apertures are positioned in the bottom side. An air mixer is positioned below the burner tube. The air mixer has a plurality of air openings extending therethrough. A blower directs air upwardly to the burner tube so that the air can be heated by the burner tube.

11 Claims, 7 Drawing Sheets

GRAIN DRYING APPARATUS

BACKGROUND OF THE DISCLOSURE

Field of the Disclosure

The disclosure relates to grain dryer burner devices and more particularly pertains to a new grain dryer burner device for providing a more fuel efficient and weather tolerable burner tube.

SUMMARY OF THE DISCLOSURE

An embodiment of the disclosure meets the needs presented above by generally comprising a gas supply line is fluidly coupled to a gas supply. A burner tube is fluidly coupled the gas supply line and has a top side and a bottom side. The burner tube has a plurality of apertures extending therethrough and the apertures are positioned in the bottom side. An air mixer is positioned below the burner tube. The air mixer has a plurality of air openings extending therethrough. A blower directs air upwardly to the burner tube so that the air can be heated by the burner tube.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
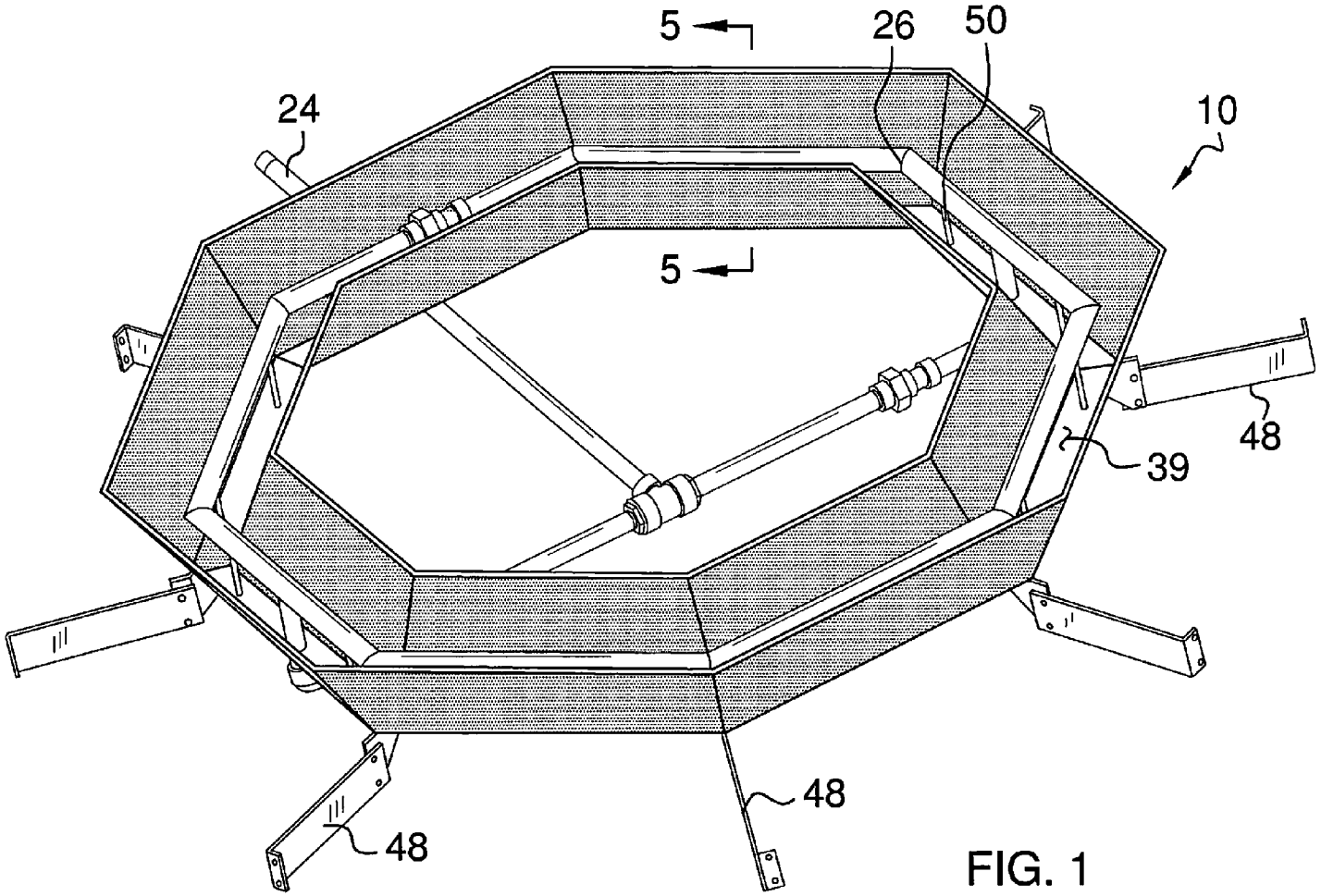
FIG. 1 is a top perspective view of a dryer burner apparatus according to an embodiment of the disclosure.
Figure 2:
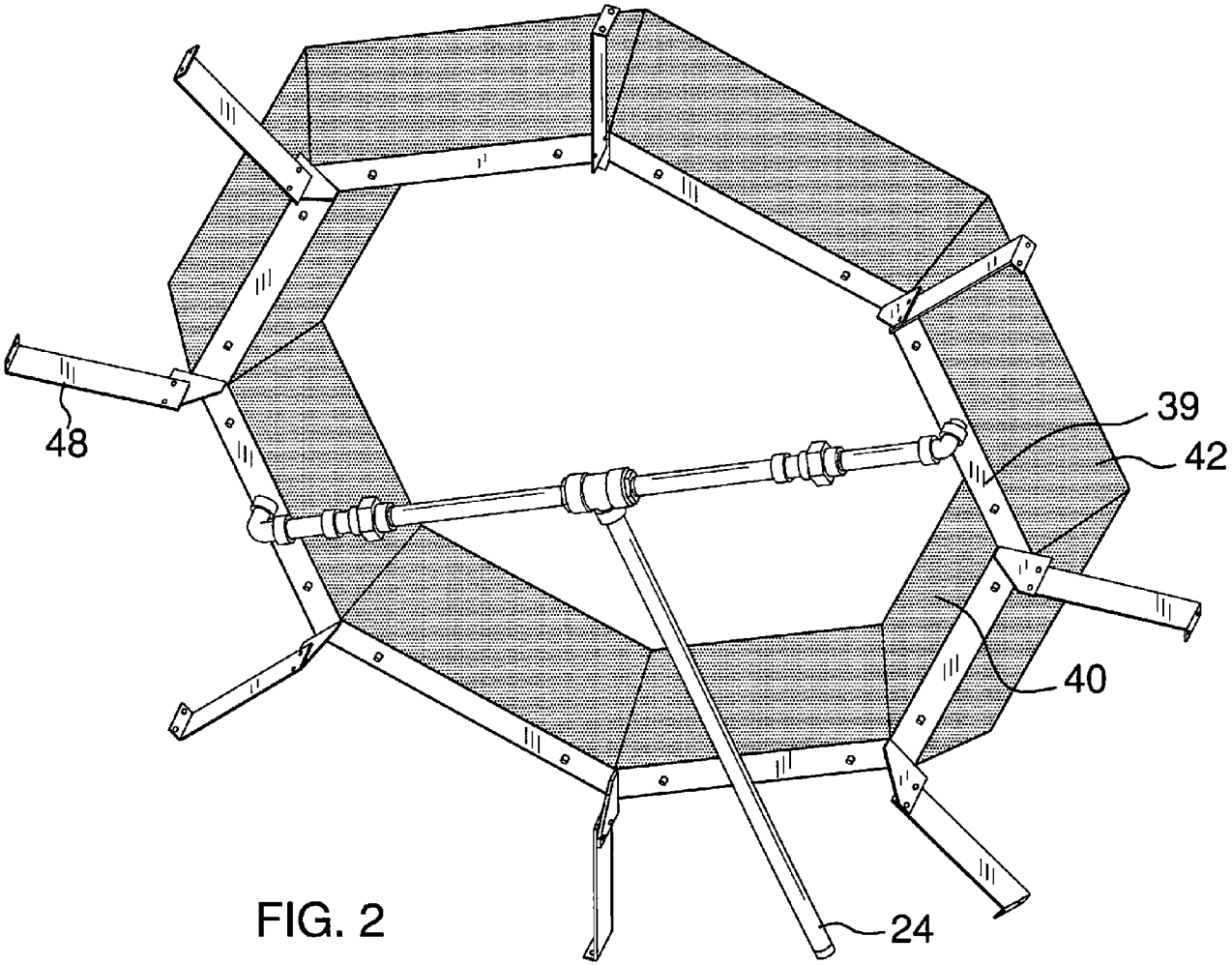
FIG. 2 is a bottom perspective view of an embodiment of the disclosure.
Figure 3:
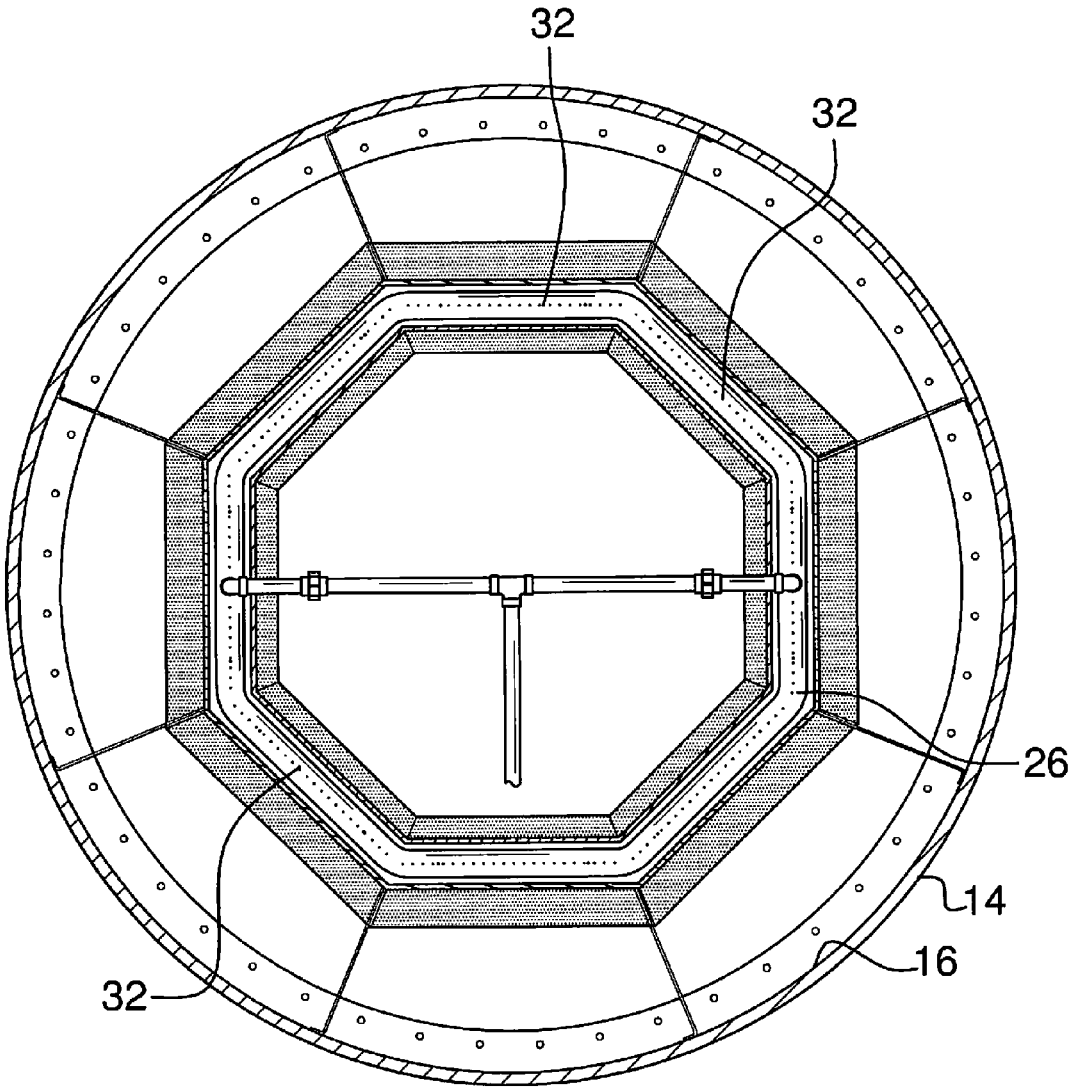
FIG. 3 is a bottom broken view of an embodiment of the disclosure having a bottom wall of an air mixer removed.

With reference now to the drawings, and in particular to FIGS. 1 through 7 thereof, a new grain dryer burner device embodying the principles and concepts of an embodiment of the disclosure and generally designated by the reference numeral 10 will be described.

As best illustrated in FIGS. 1 through 7, the dryer burner apparatus 10 generally is contained within or includes a housing 12 with a perimeter wall 14 that has an inner surface 16.

Figure 7:
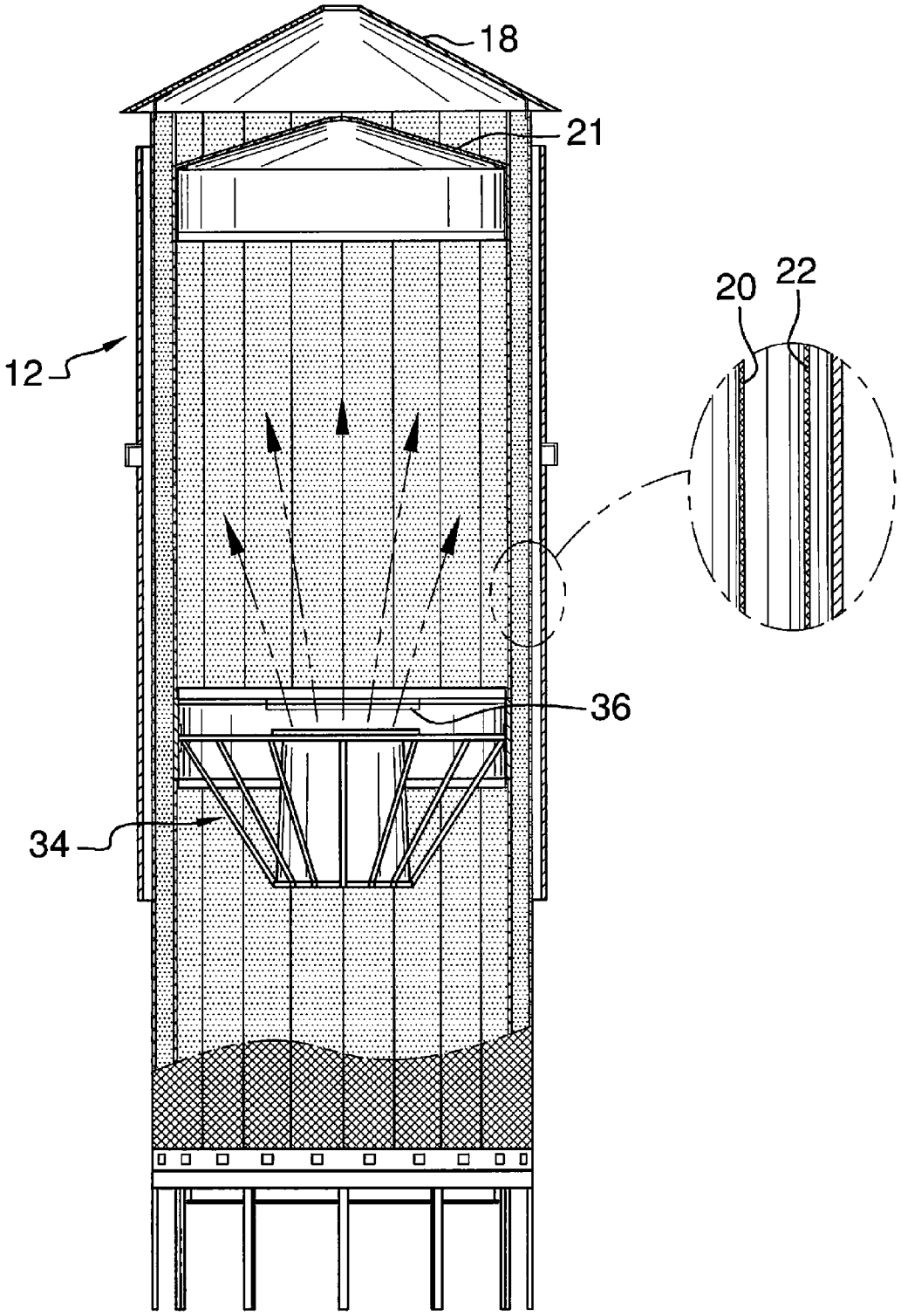
FIG. 7 is a side in-use view of an embodiment of the disclosure.

The housing 12, more particularly, may comprise a grain dryer housing. Such housings 12 typically have an open top wall 18 for allowing grain, including corn, to fall into the housing 12 such that it is moved to the perimeter wall 14. The perimeter wall 14, as shown in FIG. 7 is often a double-walled structure which is perforated and allows free transfer of air through the perimeter wall 14. The grain falls between an inner wall 20 and an outer wall 22 of the perimeter wall 14 and is dried as heated air passes through perimeter wall 14. The grain eventually falls outwardly of the housing 12 to be transported away in a conventional manner.

A gas supply line 24 is fluidly coupled to a gas fuel supply. The gas supply line 24 extends into the housing. The gas supply typically provides a gaseous fuel such as propane or methane though apparatus 10 is not directed toward a particular type of fuel and any conventional fuel used in the grain drying arts may be employed.

A burner tube 26 is fluidly coupled the gas supply line 24. The burner tube 26 is positioned within the housing 12 and has a top side 28 and a bottom side 30. The burner tube 26 has a plurality of apertures 32 extending therethrough. At least a majority of the apertures 32 is positioned in the bottom side 30 and up to all of the apertures 32 may be positioned in the bottom side 30. The term "bottom side" is intended to mean at least below a horizontal plane vertically bisecting the burner tube 26 and more particularly may indicate a lowest vertical surface, or bottom surface, of the burner tube 26.

The positioning of the apertures 32 serves multiple advantageous purposes. The first purpose is to prevent access to the burner tube 26 of the elements due to the top wall 18 of the housing 12 being open. This will prevent rusting of the burner tube 26 as well as clogging of the apertures 32. Such a design therefore further prevents the requirement of a shroud over the burner tube 26 to protect it from the elements. Second, when the fuel is ignited, flames will extend downwardly from the burner tube 26 and fan outwardly on either side of the burner tube 26. This action in turn heats the burner tube 26. As the burner tube 26 is heated, the fuel inside of the burner tube 26 will increase in temperature and thereby burn more efficiently when ejected from the apertures 32. A third advantage is that because the fuel is ejected downwardly, it is caught by the upwardly moving air (i.e. atmospheric gases adjacent to the housing and injected into the housing by a blower 34) and must travel upwardly through the already ignited fuel. This travel distance provides additional time for the fuel to mix with oxygen and ignite the fuel to temper fuel loss. Conventional burners in grain dryers eject the fuel upwardly which encourages a larger percentage of fuel to escape the housing before it can be ignited. Therefore, the positioning of the apertures 32 again promotes a more efficient use of the fuel.

As is shown in the Figures, the burner tube 26 may be formed into a continuous loop. The loop may be curved or formed from straight sections of piping. In particular, the burner tube 26 may form at least 80% of a continuous loop as it is understood in the art that substantially even distribution of heat is the important mitigating factor. Though a closed loop may be used to efficiently ensure even distribution of fuel and heat, other shapes or designs may be utilized. Thus, a single elongated pipe may be used which either may be straight or made into any number of various shapes. Alternatively, a series of branch pipes could be fluidly coupled to the supply line at various points and radiate outwardly therefrom, be orientated parallel to each other or placed in a consecutive pattern substantially emulating a looped shape. However, a continuous loop, or a substantially continuous loop, would have the advantage of placing evenly distributed heat continuously along the inner surface 16 of the perimeter wall 14.

Figure 4:
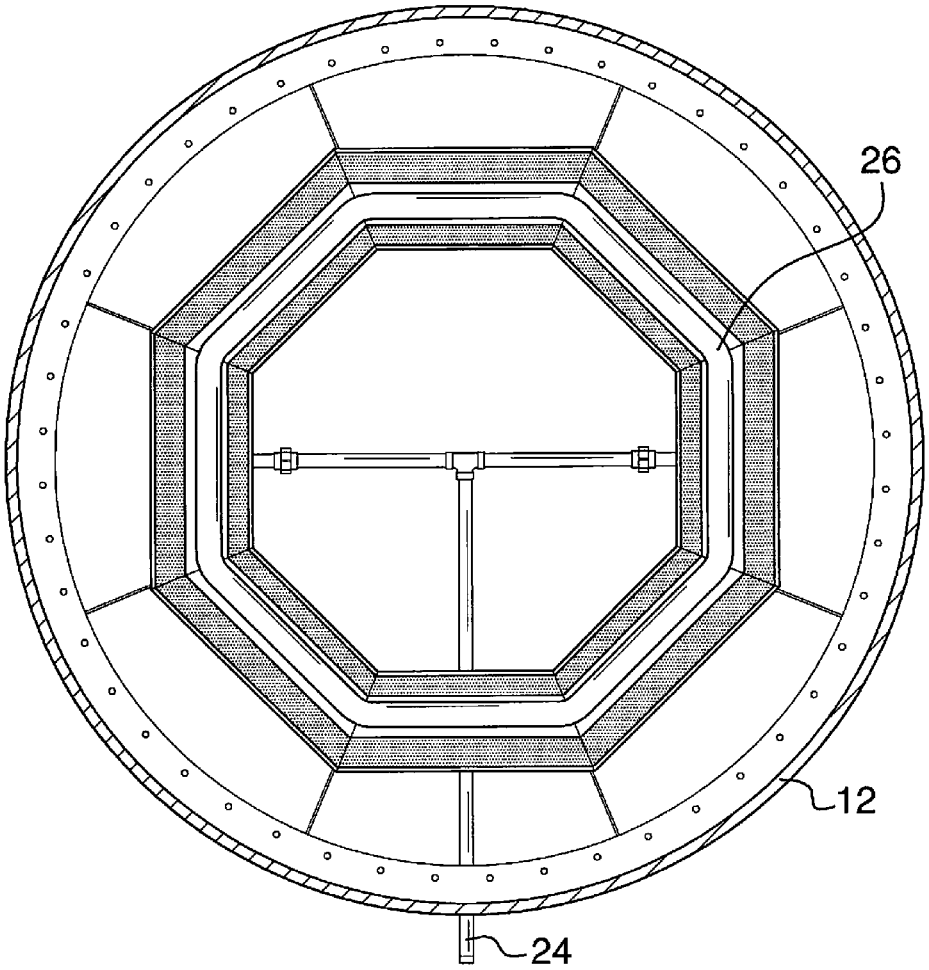
FIG. 4 is a top view of an embodiment of the disclosure.
Figure 5:
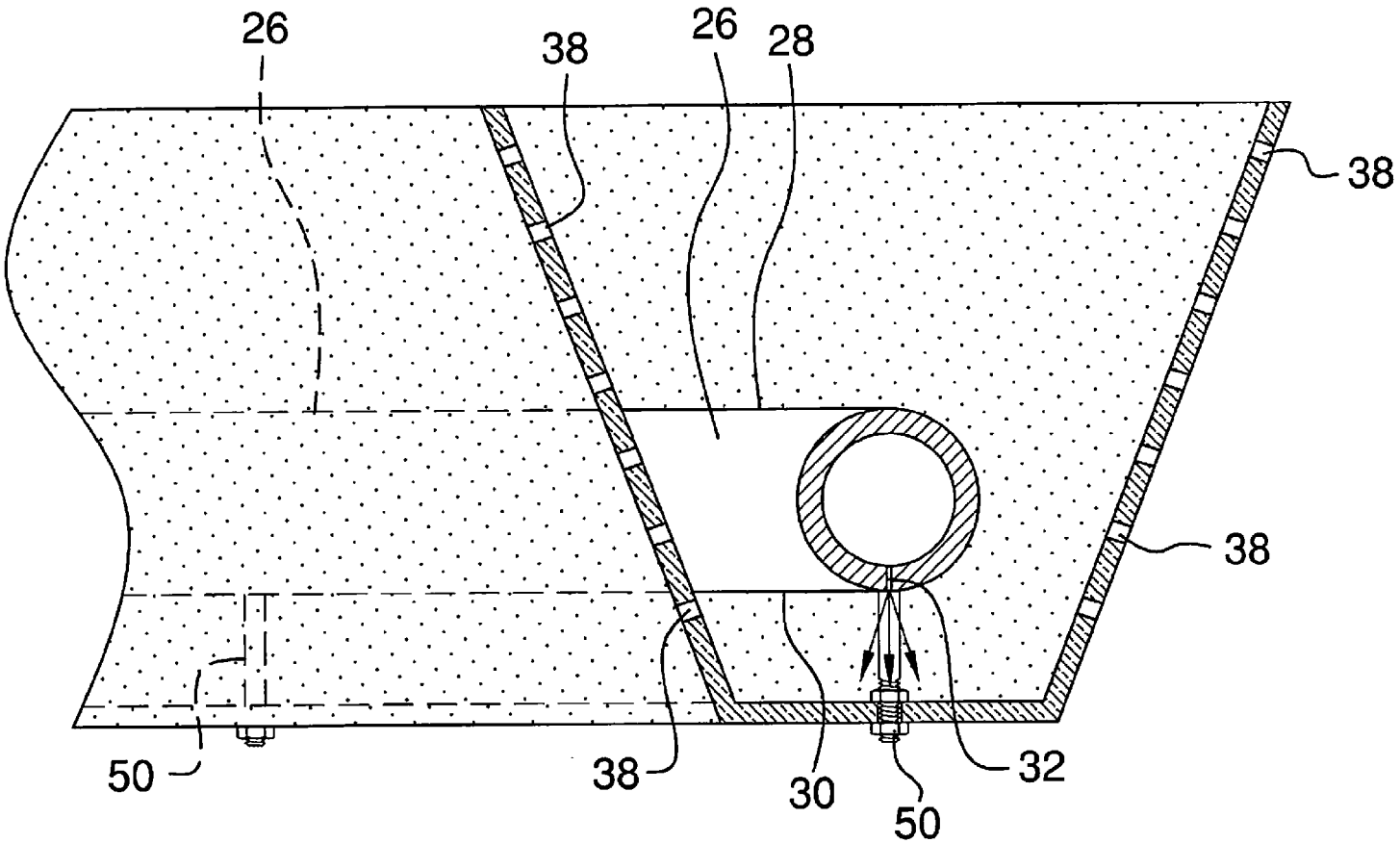
FIG. 5 is a cross-sectional view of an embodiment of the disclosure taken along line 5-5 of FIG. 1.
Figure 6:
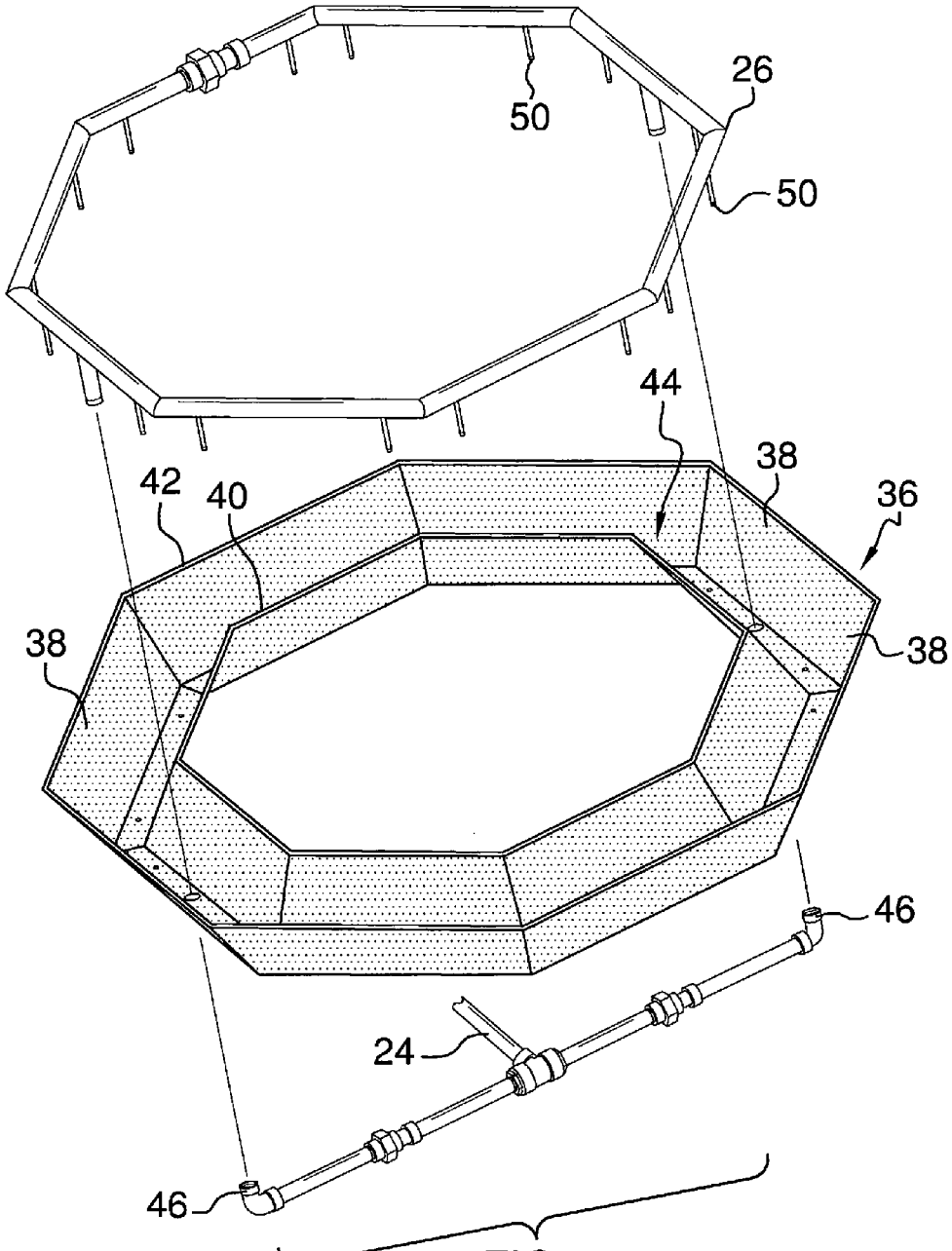
FIG. 6 is an exploded perspective view of an embodiment of the disclosure.

An air mixer 36 is positioned below the burner tube. The air mixer 36 has a plurality of air openings 38 extending therethrough for allowing air to flow upwardly through the air mixer 36 and blend with the fuel as it leaves the burner tube 26. The air mixer 36 includes a bottom wall 39 having an inner perimeter edge and an outer perimeter edge. An inner wall 40 is coextensive with and extending upwardly from the inner perimeter edge an outer wall 42 is coextensive with the outer perimeter edge. A receiving space 44 is defined between the inner 40 and outer 42 walls and the burner tube 26 is positioned in the receiving space 44. While the air mixer 36 is shown as a closed loop, it should be understood that typically the air mixer 36 will likely have a shape to match the shape of the burner tube 26. As can be seen in the Figures, the supply pipe 24 may include one or more branches 46 extending off of a primary supply pipe. The one or more branches 46 may be positioned such that they extend upwardly through the air mixer 36. As can be seen in FIG. 4, for instance, the air mixer 36 may be coupled to the inner surface 16 of the housing 12 by way of a plurality of mounting brackets 48. A plurality of supports 50 may be provided that extend between and abut, or are attached to, the burner tube 26 and the air mixer 36. The supports 50 stabilize the burner tube 26 with respect to the housing 12 and to the air mixer 26.

As indicated above, a blower 34 is fluidly coupled to the housing 12. Such blowers 34 are conventional with respect to grain dryers and will typically directing air upwardly to the burner tube 26 so that the air will be heated and thereafter pass through the perimeter wall 14. This action will thereby heat and dry the grain as is well known in the arts. As stated above, the air will be directed through the air mixer 36 and in an opposite direction of fuel release through the apertures 32. Overall, this will better promote mixing of the air, and in particular the oxygen contained therein, with the fuel which is being ejected in an opposite direction of air flow.

While the above demonstrates the usefulness of the tuber burner 26 for grain trying, it should be understood that the same structure may be useful in other industries where high volume drying or heating is required and in particular where large blowers 34 are utilized. For instance, process plant burners, such as those used for drying cereal, could benefit from the advantages of the burner tube described herein. Other embodiments may be utilized for general industrial heaters, process control heating equipment and the like.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A burner assembly including;

a gas supply line being fluidly coupled to a gas supply;

a burner tube being fluidly coupled said gas supply line, said burner tube having a top side and a bottom side, said burner tube having a plurality of apertures extending therethrough, said apertures being positioned in said bottom side wherein flames emitted from said burner tube extend downwardly from said apertures when fuel exiting said burner tube is ignited;

an air mixer being positioned below said burner tube, said air mixer having a plurality of air openings extending therethrough; and a blower directing air upwardly to said burner tube.

2. The burner assembly according to claim 1, wherein said burner tube forms at least 80% of a continuous loop.

3. The burner assembly according to claim 1, wherein said air mixer includes a bottom wall having an inner perimeter edge and an outer perimeter edge, an inner wall being coextensive with and extending upwardly from said inner perimeter edge, an outer wall being coextensive with said outer perimeter edge, a receiving space being defined between said inner and outer walls, said burner tube being positioned in said receiving space.

4. The burner assembly according to claim 1, further including a plurality of supports extending between and abutting said burner tube and said air mixer.

5. A burner assembly including;

a housing including a perimeter wall having an inner surface, said perimeter wall being perforated to allow air to flow through said perimeter wall, said housing having an open top wall;

a gas supply line being fluidly coupled to a gas supply, said gas supply line extending into said housing;

a burner tube being fluidly coupled said gas supply line, said burner tube being positioned within said housing, said burner tube having a top side and a bottom side, said burner tube having a plurality of apertures extending therethrough, each of said apertures being positioned in said bottom side wherein flames emitted from said burner tube extend downwardly from said apertures when fuel exiting said burner tube is ignited;

an air mixer being positioned below said burner tube, said air mixer having a plurality of air openings extending therethrough;

said air mixer being coupled to said inner surface of said housing; and a blower being fluidly coupled to said housing, said blower directing air upwardly to said burner tube and through said perimeter wall of said housing.

6. The burner assembly according to claim 5, wherein said burner tube forms at least 80% of a continuous loop.

7. The burner assembly according to claim 5, wherein said air mixer includes a bottom wall having an inner perimeter edge and an outer perimeter edge, an inner wall being coextensive with and extending upwardly from said inner perimeter edge, an outer wall being coextensive with said outer perimeter edge, a receiving space being defined between said inner and outer walls, said burner tube being positioned in said receiving space.

8. The burner assembly according to claim 5, further including a plurality of supports extending between and abutting said burner tube and said air mixer.

9. The burner assembly according to claim 5, wherein said housing is a grain dryer housing.

10. A burner assembly including:

a housing including a perimeter wall having an inner surface, said housing having a top wall, said top wall having an opening therein configured for receiving grain, said perimeter wall being perforated;

a gas supply line being fluidly coupled to a gas supply, said gas supply line extending into said housing;

a burner tube being fluidly coupled said gas supply line, said burner tube being positioned within said housing and below said top wall, said burner tube having a top side and a bottom side, said burner tube having a plurality of apertures extending therethrough, each of said apertures being positioned in said bottom side wherein flames emitted from said burner tube extend downwardly from said apertures when fuel exiting said burner tube is ignited, said burner tube forming at least 80% of a continuous loop;

an air mixer being positioned below said burner tube, said air mixer having a plurality of air openings extending therethrough, said air mixer including a bottom wall having an inner perimeter edge and an outer perimeter edge, an inner wall being coextensive with and extending upwardly from said inner perimeter edge, an outer wall being coextensive with said outer perimeter edge, a receiving space being defined between said inner and outer walls, said burner tube being positioned in said receiving space;

said air mixer being coupled to said inner surface of said housing;

a plurality of supports extending between and abutting said burner tube and said air mixer; and a blower being fluidly coupled to said housing, said blower directing air upwardly to said burner tube.

11. The burner assembly according to claim 10, wherein said housing is a grain dryer housing.

* * * * *